US006283740B1

(12) United States Patent
Brown

(10) Patent No.: US 6,283,740 B1
(45) **Date of Patent: *Sep. 4, 2001**

(54) ROTARY LOBE PUMPS

(76) Inventor: Antony Mark Brown, 294 Willingdon Road, Eastbourne, East Sussex, BN20 9JS (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/281,408

(22) Filed: Mar. 30, 1999

Related U.S. Application Data

(63) Continuation-in-part of application No. 09/205,999, filed on Dec. 4, 1998.

(51) Int. Cl.[7] ..... F03C 2/00

(52) U.S. Cl. ..... 418/206.6; 29/888.021; 277/527; 277/529; 277/571

(58) Field of Search ..... 418/206.6; 29/888.021; 277/527, 529, 571

(56) References Cited

U.S. PATENT DOCUMENTS

| | | | | |
|---|---|---|---|---|
| 1,363,565 | * | 12/1920 | Christenson | 277/529 |
| 1,911,422 | * | 5/1933 | Bigelow et al. | 277/527 |
| 2,209,109 | * | 7/1940 | Bungartz | 277/527 |
| 2,293,505 | * | 8/1942 | Hillier | 277/527 |
| 2,853,321 | * | 9/1958 | Davey | 277/527 |
| 2,881,710 | * | 4/1959 | McLean | 277/527 |
| 3,062,556 | * | 11/1962 | Fino et al. | 277/527 |
| 4,878,677 | * | 11/1989 | Larkins et al. | 277/527 |
| 4,991,857 | * | 2/1991 | Pippert | 277/529 |
| 5,180,297 | * | 1/1993 | Hansen et al. | 418/104 |

FOREIGN PATENT DOCUMENTS

| | | | | |
|---|---|---|---|---|
| 0086002 | * | 8/1983 | (EP) | 277/571 |
| 2247047 | * | 2/1992 | (GB) | 418/104 |
| 59-224489 | * | 12/1984 | (JP) | 418/104 |
| 9849448 | * | 11/1998 | (WO) . | |

* cited by examiner

*Primary Examiner*—Thomas Denion
*Assistant Examiner*—Theresa Trieu
(74) *Attorney, Agent, or Firm*—Marshall, O'Toole Gerstein, Murray & Borun

(57) ABSTRACT

A rotary lobe pump is provided with an improved sealing mechanism between the rotor and outside diameter of the shaft upon which the rotor is mounted. An adapter is provided for the drive shaft which enables the drive shaft to be easily coupled to a variety of drive mechanisms. The adapter can be replaced with an alternative adapter suited to fit alternative drive mechanisms. An improved means for mounting the timing gears on the drive and driven shafts is provided which enables the timing gears to be easily adjusted during assembly to improve the rate at which rotary lobe pumps can be assembled. An improved shaft configuration is provided with a thicker boss section providing additional structural support at the timing gear. The shaft may be cast molded. An improved seal assembly is also provided whereby the seal is frictionally accommodated inside a sleevelike seal housing which, in turn, is frictionally accommodated inside the rotor. Upon removal of the rotor from the drive shaft or driven shaft, the seal and seal housing may be quickly and easily removed from inside the rotor for servicing or replacement.

14 Claims, 5 Drawing Sheets

ROTARY LOBE PUMPS

This is a continuation-in-part of U.S. Ser. No. 09/205,999, filed on Dec. 4, 1998, still pending.

FIELD OF THE INVENTION

The present invention relates generally to pumps and, more specifically, to lobe pumps. Still more specifically, the present invention relates to an improved seal disposed between the rotors and shaft, splined inserts or adapters enabling the drive shaft to be coupled to a variety of motor drives and an improved means of adjusting the timing of rotary lobe pumps.

BACKGROUND OF THE INVENTION

Rotary lobe pumps are known. Lobe pumps are ideal for pumping shear-sensitive products because the rotating lobes or rotors do not engage one another. Instead, when a lobe pump is properly timed, the rotors make no contact with each other. Accordingly, shear sensitive fluids may be pumped with minimal shear forces imposed on the fluids by the rotors. Traditionally, rotary lobe pumps have been used in sanitary applications, including food and health care products. The pumping chambers are sealed for sanitary reasons and the drive and driven shafts are supported with bearings disposed outside of the pump chamber.

In some lobe pump designs, the rotors are fixedly mounted onto a shaft which passes through the rotor case. The shaft passes through a sleeve support which, in turn, is connected to the rotor case. Because the shaft rotates within the sleeve support and the outside diameter of the shaft and the inside diameter of the sleeve support are closely matched, the positioning of sealing members between the shaft and sleeve support is not possible. However, the positioning of seals between the sleeve support and the rotor case is feasible. In order to prevent fluid from migrating between the shaft and sleeve support, an effective sealing mechanism must be placed between the sleeve support and an inside surface of the rotor. This is problematic because most sealing mechanisms are designed to seal radially inward. However, in the case of rotary lobe pumps employing a sleeve support through which the shaft passes, the sleeve support is stationary and disposed radially inside of an opposing portion of the rotor. Therefore, there is a need for an improved sealing mechanism or seal assembly for mounting on a stationary sleeve support and extending radially outwardly for sealing in a radially outward direction against an inside surface of a rotating rotor.

Further, rotary lobe pumps are typically designed to be coupled with motors of a variety of types. Because motor drives, such as hydraulic motor drives, different motor drives can require different drive shaft designs for the rotary lobe pump. Accordingly, the pump manufacturer must be able to provide a variety of drive shafts for its pump to enable its pumps to be utilized with a wide variety of drive mechanisms. In order to avoid the expense and inconvenience of providing a number of different drive shafts for each rotary lobe pump, manufacturers need a reliable adapter system to enable a single drive shaft to be coupled to a variety of motor drives.

Another problem associated with the use of rotary lobe pumps is the timing or synchronization of the contra-rotating rotors. As noted above, the timing must be exact so that clearances are maintained to prevent rotor-to-rotor contact. The requirement of precise timing makes the assembly of rotary lobe pumps time consuming and, therefore, expensive. Further, because the timing gears are typically fixedly mounted to the drive and driven shafts, the entire shaft assembly must be rotated during the timing adjustment process. Accordingly, there is a need for an improved timing gear/shaft design which enables either the timing gears or the shafts to be rotated during the timing adjustment instead of current designs which require the entire shaft/timing gear assembly to be rotated. By permitting the operator to rotate only the timing gears, the timing adjustment process could be shortened and therefore manufacturing costs could be reduced.

A need also arises when it is desired to change the timing gears during the working life of the pump. Specifically, it may be desirable to switch from a straight timing gear to a slanted or herringbone type timing gear. Thus, there is a need for a timing gear configuration whereby the timing gears can be easily replaced.

Still another problem that arises with the seals of rotary lobe pumps and other pumps is the difficulty in changing the seals or servicing the seals. Often, the pump must be substantially disassembled which requires that the pump be taken out of service. Accordingly, there is a need for an improved pump whereby the seals disposed between the shaft and the rotor can be quickly and easily changed or serviced on-site and without the need for taking the pump out of service.

Further, there is a need for a rotary lobe pump whereby the shaft/rotor seals can be easily accessed for repair and maintenance with a minimum of pump disassembly.

SUMMARY OF THE INVENTION

The present invention satisfies the aforenoted needs by providing a rotary lobe pump that comprises a shaft extending through a rotor case before being connected to a rotor at a shaft/rotor connection. The rotor comprises an inside surface oppositely disposed to an outside surface of the shaft. The pump further comprises a seal assembly for providing a seal between the inside surface of the rotor and the outside surface of the shaft.

The seal assembly comprises a sleeve support through which the shaft passes before the shaft is connected to the rotor. The sleeve support is fixedly connected to the rotor case. The sleeve support extends from the rotor case along the shaft and towards the shaft/rotor connection. The sleeve support passes through an elongated seal.

The elongated seal is disposed between the shaft/rotor connection and the rotor housing. The elongated seal is frictionally secured to the outer surface of the seal support and extends radially outwardly to engage the inside surface of the rotor.

In an embodiment, the elongated seal comprises a multiple lip seal.

In an embodiment, the multiple lip seal comprises an outer side comprising a plurality of lips that extend radially outwardly at an angle towards the rotor case. The lips each comprise a distal end that engages the inside surface of the rotor.

In an embodiment, the elongated seal comprises an external packed gland seal.

In an embodiment, the packed gland seal comprises a plurality of packed glands having an outside surface that engages the inside surface of the rotor.

In an embodiment, the sleeve support comprises an outer surface with at least one circumferential groove disposed therein for accommodating an O-ring. The O-ring is trapped between the sleeve support and the elongated seal.

In an embodiment, the sleeve support comprises two circumferential grooves for accommodating O-rings trapped between the outer surface of the sleeve support and the inside surface of the elongated seal.

In an embodiment, the inside surface of the rotor accommodates a wear sleeve. The elongated seal engages the wear sleeve.

In an embodiment, the inside surface of the rotor comprises a slot for accommodating a wear sleeve. The elongated seal engages the wear sleeve.

In an embodiment, the sleeve support comprises a threaded section disposed opposite the rotor case from the rotor. The threaded section threadably receives a threaded lock ring. The threaded lock ring engages the rotor case and secures the sleeve support against the rotor case.

In an embodiment, at least one seal is disposed between the rotor case and the sleeve support.

In an embodiment, the present invention provides a pump driven by a motor drive. The pump comprises a drive shaft having an end for connection to a drive mechanism. The end of the drive shaft matably receives a splined insert. The splined insert matably connects with a motor drive. The splined insert is secured within the end of the drive shaft with an adhesive. Accordingly, the splined insert can be removed and replaced with another splined insert for purposes of matably engaging the other splined insert with another motor drive.

In an embodiment, the adhesive is LOCTITE® 648.

In an embodiment, the present invention provides a method for reconfiguring a pump for connection from one motor drive to a second motor drive. The method comprises the steps of providing a pump with a drive shaft having an end for connection to a drive mechanism. The end of the drive shaft is matably received in a first splined insert. The first splined insert matably connects with a first motor drive. The first splined insert is secured to the end of the drive shaft with an adhesive. The method further includes the steps of disconnecting the first splined insert from the first motor drive, removing the first splined insert from the drive shaft, applying adhesive to the end of the drive shaft, mounting a second splined insert onto the end of the drive shaft, and, connecting the second splined insert to the second motor drive.

In an embodiment, the present invention provides a pump that comprises a drive shaft that passes through and that is fixedly attached to a first cylindrical boss. The first cylindrical boss extends radially outwardly from the drive shaft. The first boss comprises at least one threaded aperture. The first boss engages a first timing gear. The first timing gear comprises at least one elongated slotted hole. The pump further comprises a first fastener comprising a threaded shaft that passes through the elongated slot of the first timing gear and that is received in the threaded aperture of the first boss. The first fastener further comprising a head for clamping the first timing gear to the first boss. The elongated slotted hole permits rotational adjustment of the first timing gear with respect to the first boss prior to tightening of the first fastener.

In an embodiment, the pump further comprises a driven shaft that passes through and that is fixedly attached to a second cylindrical boss. The second cylindrical boss extends radially outwardly from the driven shaft. The second boss comprises at least one threaded aperture. The second boss engages a second timing gear. The second timing gear comprises at least one elongated slotted hole. The pump further comprises a second fastener comprising a threaded shaft that passes through the elongated slotted hole of the second timing gear and that is received in the threaded aperture of the second boss. The second fastener further comprises a head for clamping the second timing gear to the second boss. The elongated slotted hole of the second timing gear permits rotational adjustment of the second timing gear with respect to the second boss prior to tightening of the second fastener. The first and second timing gears are enmeshed.

In an embodiment, the first and second timing gears each comprise a plurality of elongated slotted holes and the pump comprises a plurality of fasteners, one fastener for each elongated slotted hole of the first and second timing gears. Further, the first and second bosses each comprise a plurality of threaded apertures, one threaded aperture for each fastener and for each elongated slotted hole of the first and second timing gears respectively.

In an embodiment, the first and second timing gears each comprise a hole for receiving a dowel. Once the positions of the timing gears are adjusted, a hole is drilled in each boss in alignment with the timing gear holes and a dowel is driven through each timing gear and into its respective boss to secure the position of each timing gear with respect to each boss.

In an embodiment, the present invention provides a method for adjusting the timing of a rotary lobe pump as described above that includes the steps of adjusting the position of the first timing gear with respect to the first boss by rotating the first timing gear, tightening the first fastener and clamping the first timing gear against the first boss with the head of the first fastener.

In an embodiment, the method further comprises the steps of drilling aligned holes through the first timing gear and first boss, and, driving a dowel in said aligned holes.

In an embodiment, the method further comprises the steps of adjusting the position of the second timing gear with respect to the second boss by rotating the second timing gear, and, tightening the second fastener and clamping the second timing gear against the second boss with the head of the second fastener.

In an embodiment, the method further comprises the step of drilling aligned holes through the second timing gear and second boss, and, driving a dowel into said aligned holes.

In an embodiment, pre-drilled holes for the dowels are provided in each timing gear.

In an embodiment, the drive and driven shafts of the present invention may include a stepped configuration as follows. Specifically, the inboard end of the drive shaft, which is connected to the motor drive passes through a support bearing and has a first diameter. The shaft includes a first boss disposed between the inboard end of the shaft and the rotor case. The first boss has a second diameter that is larger than the first diameter. The segment of the drive shaft that passes through the rotor case and the sleeve support has a third diameter that is smaller than the second diameter or the diameter of the first boss. The outboard end of the drive shaft that is connected to the first rotor has a fourth diameter, that is smaller than the third diameter. Thus, from the first boss through the outboard end of the drive shaft, the drive shaft has a stepped-down configuration. Further, in an embodiment, the drive shaft passes through a second support bearing disposed between the first boss and the rotor case. The portion of the drive shaft that passes through the second support bearing has a fifth diameter that is larger than the third diameter (i.e. the portion of the drive shaft that passes through the rotor case and sleeve support) and that is smaller than the second diameter (i.e. the diameter of the first boss).

In an embodiment, an analogous stepped-down configuration is provided for the driven shaft as well.

In an embodiment, the shaft/rotor seals may be easily serviced and/or replaced by removing an outer plate and detaching the rotors from the drive and driven shafts. Once the rotors are removed, the seal assemblies are easily accessed.

In an embodiment, the elongated seal of the seal assembly is accommodated in a seal housing and is disposed between the sleeve support and the seal housing. The seal housing is frictionally accommodated in the inside surface of the rotor by way of a clearance fit so that the seal housing is disposed between the elongated seal and the inside surface of the rotor. By providing an elongated seal accommodated in a sleeve-like seal housing, the seal housing can be quickly removed from the rotor and the elongated seal replaced quickly and easily.

In an embodiment, a seal is provided between an outside surface of the seal housing and the inside surface of the rotor by way of one or more O-rings.

In an embodiment, the elongated seal is disposed between the shaft/rotor connection and the rotor case. The elongated seal is frictionally secured to an inner surface of the seal housing and the seal extends radially inwardly to engage an outside surface of the sleeve support.

In an embodiment, the elongated seal is a lip seal which comprises an inner side comprising a plurality of lips that extend axially inwardly towards the rotor case. The lips each comprise an inner surface that engages the outside surface of the sleeve support.

It is therefore an advantage of the present invention to provide an improved sealing mechanism for a rotary lobe pump.

Yet another advantage of the present invention is that it provides an improved rotary seal whereby the inside surface of the seal is mounted on a fixed member and the outside surface of the seal sealingly engages a rotating member.

Yet another advantage of the present invention is that it provides a convenient adapter system for drive shafts of rotary pumps.

Still another advantage of the present invention is that it enables the pump manufacturer to manufacture a single drive shaft configuration but still enables the drive shaft to be coupled to a variety of drive mechanisms or motor drives.

Another advantage of the present invention is that it provides an improved and more convenient way for adjusting the timing of a rotary lobe pump.

And another advantage of the present invention is that it provides an improved rotary lobe pump that is easier to service and maintain.

Other objects and advantages of the present invention will become apparent upon reading the following detailed description and appended claims, and upon reference to the accompanying drawings.

BRIEF DESCRIPTION OF THE DRAWINGS

For a more complete understanding of the invention, reference should now be made to the embodiments illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
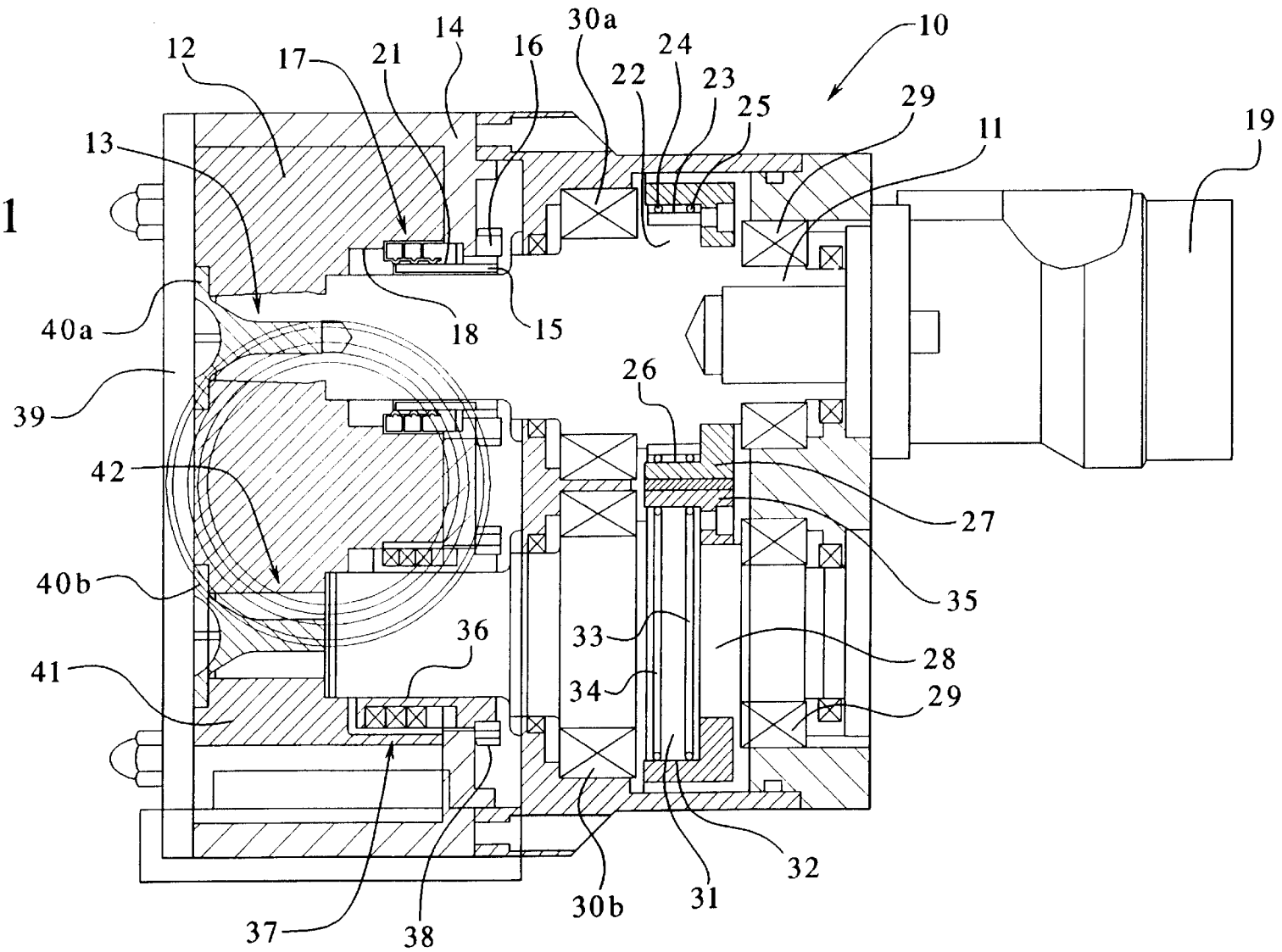
FIG. 1 is a sectional view of a rotary lobe pump made in accordance with the present invention.

Turning first to FIG. 1, a rotary lobe pump 10 is illustrated which includes a drive shaft 11 connected at one end to a rotor 12 at a shafurotor connection shown generally at 13 and to a motor drive 19 at its opposing or inboard end. The shaft 11 passes through both a rotor casing 14 and a sleeve support 15 which is discussed in greater detail below with respect to FIGS. 2 and 4. The sleeve support 15 is connected to the rotor casing 14 by way of the lock ring 16. The sleeve support 15 supports a seal assembly 17 disposed between an inside surface 18 of the rotor 12 and an outside surface 21 of the sleeve support 15. Again, the seal assembly 17 will be discussed in greater detail below with respect to FIG. 4.

Still referring to FIG. 1, the drive shaft 11 includes a first boss 22 having an outer circumferential surface 23 with grooves disposed therein for accommodating O-rings 24, 25. The O-rings engage the inside surface 26 of a first timing gear 27. As discussed below with respect to FIGS. 7 and 8, the position of the first timing gear 7 on the first boss 22 is adjustable.

The pump 10 also includes a driven shaft 28 which, like the drive shaft 11 includes a second boss 31 with an outer circumferential surface 32 having grooves disposed therein for accommodating the O-rings 33, 34. The second boss 31 accommodates a second timing gear 35 whose position on the second boss 31 is adjustable as discussed below with respect to FIGS. 7 and 8. The driven shaft 28 also passes through the rotor housing 14 and through a sleeve support 36 that accommodates a seal assembly 37 that includes a multiple packing gland seal that is discussed in greater detail with respect to FIG. 4. A lock nut 38 that is threadably engaged to the sleeve support 36 secures the sleeve support to the rotor case 14. The driven shaft 28 is also connected to a rotor 41 at a shaft/rotor connection shown generally at 42.

Access to the seal assemblies 17, 37 is obtained by removing the cover plate 39 and detaching the rotors 12, 41 from the shafts 11, 28 by removing the threaded fasteners shown at 40*a*, 40*b* respectively.

It will be noted that the segments of the shafts 11, 28 that pass through the bearings shown at 29 have a diameter that is less than the diameter of the bosses 22, 31. It will also be noted that the diameter of the segments of the shafts 11, 28 that pass through the seal assemblies 17, 37 is less than the diameter of the bosses 22, 31 as is the diameter of the shafts 11, 28 at the shaft/rotor connections 13, 42 as is the diameter of the segments of the shafts 11, 28 that pass through the bearings shown at 30*a*, 30*b*. The strongest or stiffest portions of the shafts 11, 28 are provided at the timing gears 27, 35. The shafts 11, 28 may be cast molded as opposed to being fabricated from bar stock.

Figure 2:
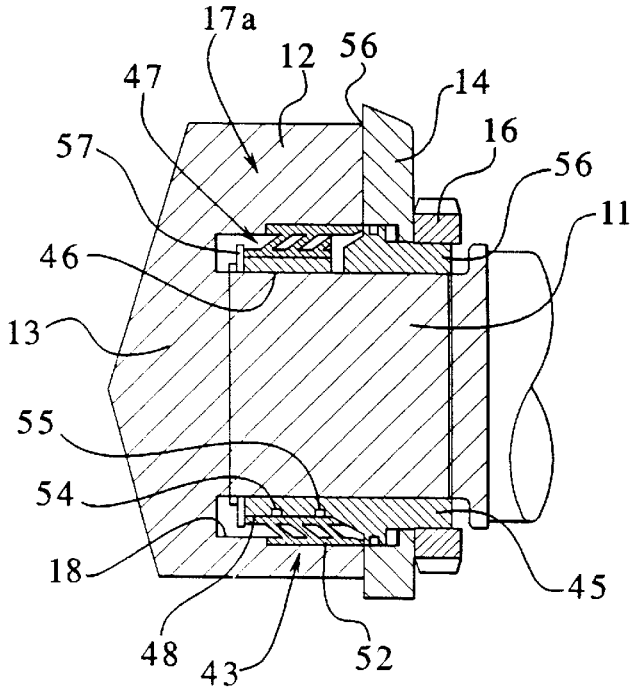
FIG. 2 is a partial sectional view of a shaft and rotor equipped with a seal assembly made in accordance with the present invention.
Figure 3:
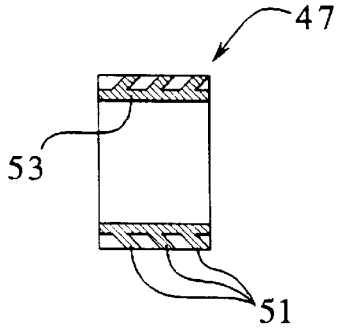
FIG. 3 is a sectional view of a multiple lip seal shown in FIG. 2.

Turning to FIG. 2, one embodiment of a seal assembly 43 is illustrated. The shaft 11 (either a drive shaft or driven shaft) passes through the rotor case 14 and a sleeve support 45. The sleeve support 45 is secured to the rotor case 14 by way of its threaded connection to a lock ring 16. The sleeve support 45 includes an inside surface 46 having a diameter only slightly larger than the outside diameter of the shaft 11. Despite the close tolerance required to permit the shaft 11 to rotate freely within the sleeve support 45, leakage could still occur between the shaft 11 and inside surface 46 of the sleeve support 45. In order to prevent this occurrence, a multiple lip seal 47 is provided between the outside surface 48 of the sleeve support 45 and the inside surface 18 of the rotor 12. The multiple lip seal 47 is further illustrated in FIG. 3. Specifically, the lip seal 47 includes a plurality of radially outwardly extending lips 51 which engage a wear sleeve 52 disposed in a slot disposed in the inside surface 18 of the rotor 12. A similar wear sleeve and slot are provided in the rotor 41. The inside surface 53 of the multiple lip seal 47 is frictionally secured to the outside surface 48 of the sleeve support 45. To provide a seal between the inside surface 53 of the lip seal 47 and the outside surface 48 of the sleeve support 45, notches are provided in the outside surface 48 of the sleeve support 45 which accommodate the O-rings shown at 54, 55.

Therefore, the multiple lip seal 47 with the engagement of its lips 51 against the wear sleeve 52 and the provision of the O-rings 54, 55 between the outside surface 48 of the sleeve support 45 and the inside surface 53 of the lip seal 47 prevents fluid from migrating through the junction or seam 56 between the rotor 12 and rotor case 14 from reaching the junction between the inside surface 46 of the sleeve support 45 and the outside surface 56 of the shaft 11. A snap ring 57 is also provided to maintain the position of the lip seal 47 within the slot disposed in the outer surface 48 of the sleeve support 45 as shown.

Further, it will be noted that product pressure applied through the junction or seam 56 will enhance the effectiveness of the seal of the multiple lip seal 47 because the lips 51 are angled toward the rotor case 14 and migration of fluid towards the shaft/rotor connection 13 results in a biasing of the lips 51 upward against the wear sleeve 52. As a result, the higher the product pressure, the greater the enhancement of the effectiveness of the multiple lip seal 47.

Figure 4:
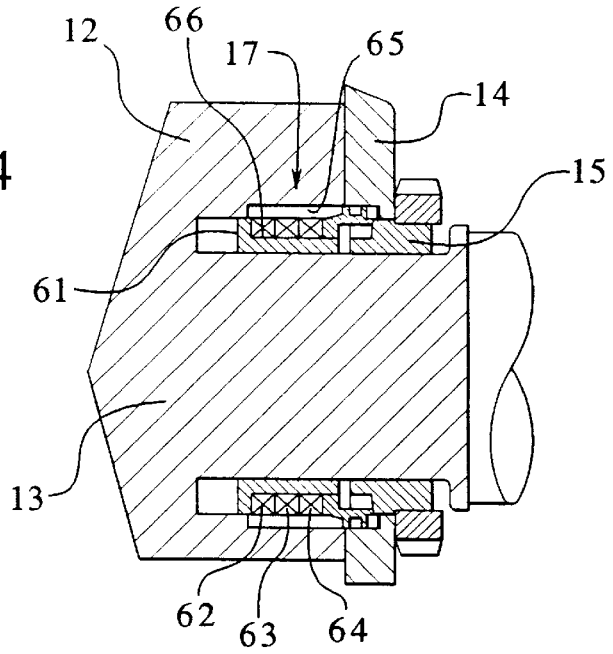
FIG. 4 is a sectional view of a shaft and rotor equipped with a packing gland seal as illustrated in FIG. 1.

FIG. 4 illustrates the multiple packing gland seal assembly 17 shown in FIG. 1. It will be noted that the multiple packing gland seal assembly shown in FIG. 4 is interchangeable with the multiple lip seal assembly 47 shown in FIGS. 2 and 3. The sleeve support 15 is configured slightly differently in that it has a terminating flange 61 for holding the multiple packing seals 62, 63, 64 in place. A slot 65 in the rotor 12 is illustrated for accommodating a wear sleeve like the one shown at 52 in FIG. 2. The packing seals 62–64 remain stationary on the outer surface 66 of the sleeve support 15 and sealingly engage the rotating wear sleeve (not shown) disposed in the slot 65 of the rotor 12.

Thus, similar to the multiple lip seal assembly 17*a* shown in FIG. 2, the multiple packing gland seal assembly 17 shown in FIG. 4 remains stationary on the sleeve support 15 and seals against a rotating wear sleeve disposed radially outwardly from the seal assembly 17. In contrast, conventional packing seals seal on an inside diameter with the shaft rotating.

Figure 5:
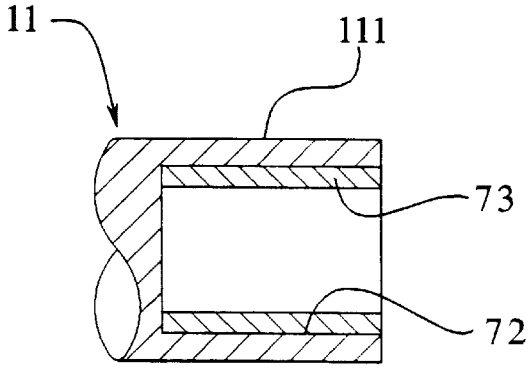
FIG. 5 is a sectional view of an end of a drive shaft equipped with a splined insert in accordance with the present invention.
Figure 6:
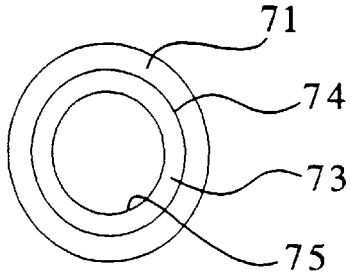
FIG. 6 is an end view of the drive shaft and a splined insert shown in FIG. 5.

Turning to FIG. 5, an inboard end 111 of a drive shaft 11 is illustrated. The end 111 includes an aperture 72 for accommodating the splined insert 73. The splined insert 73 includes an inner splined surface 75 which is designed to mate with a specific motor drive, such as the drive 112 shown in FIG. 9. The splined insert 73 is secured to the end 71 of the drive shaft 11 with a layer of adhesive 74 (see FIG. 6). By utilizing adhesive 74 to secure the splined insert 73 in place, the splined insert 73 can be removed with an appropriate solvent and replaced with an alternative splined insert for use with an alternative motor drive. Thus, a single drive shaft 11 may be coupled to a variety of motor drives thereby enhancing the versatility of the rotary lobe pump of the present invention. Further, the splined insert 73 concept may be applied to other pumps equipped with a drive shaft. Accordingly, the embodiments shown in FIGS. 5 and 6 are not limited to rotary lobe pumps. See also the seals i.e. gear pump.

Figure 7:
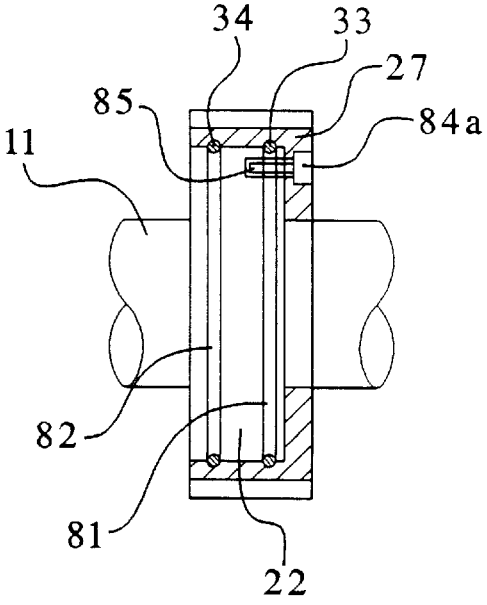
FIG. 7 is a partial sectional view of a shaft equipped with a boss and timing gear made in accordance with the present invention.
Figure 8:
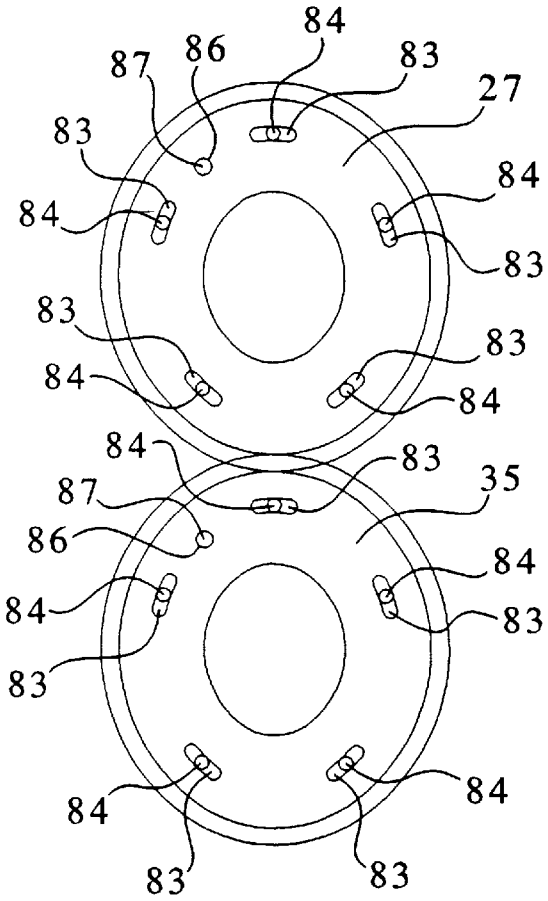
FIG. 8 is a plan view of two timing gears made in accordance with the present invention.

Turning to FIGS. 7 and 8, a shaft 11 is illustrated with a first boss 22. The first boss 22 includes dual peripheral slots 81, 82 for accommodating the O-rings 33, 34 respectively. The first timing gear 27 is mounted onto the first boss 22 as shown. Turning to FIG. 8, the first timing gear 27 includes a plurality of elongated slotted holes 83 which accommodate cap screws 84. The cap screws 84 are received in threaded apertures disposed in the first boss 27, one of which is shown at 85. By threading the cap screws 84 in the threaded apertures 85 in a loose manner, the first timing gear 27 can be rotated clockwise or counterclockwise to a limited degree provided by the slotted holes 83. Accordingly, the timing gear 27 can be easily adjusted on the boss 22 which, in turn, is fixedly connected to the drive shaft 11. Similarly, the second timing gear 35 is also equipped with slotted holes 83 and cap screws 84. The second timing gear 35 is connected to the second boss 31 in the same manner. Once the timing is set, the cap screws 84 are tightened so the heads 84*a* of the cap screws 84 bind the gears 27, 35 against the bosses 22, 31. The timing gears 27, 35 are then permanently secured to the bosses 22, 31 by drilling holes 86 in both the timing gears 27, 35 and the bosses 22, 31 respectively. After the holes 86 are drilled that extend through both the timing gears 27, 35 and partially through the bosses 22, 31 respectively, dowels 87 are driven through the holes 86 to secure the timing gears 27, 35 in place. Accordingly, the position of the timing gears 27, 35 on the bosses 22, 31 respectively can be easily adjusted which substantially improves the rate at which the rotary lobe pump 10 can be assembled. It will be noted that the holes 86 are preferably pre-drilled in the timing gears 27, 35 and the cooperating holes in the bosses 22, 31 are drilled after the cap screws 84 have been tightened.

Figure 9:
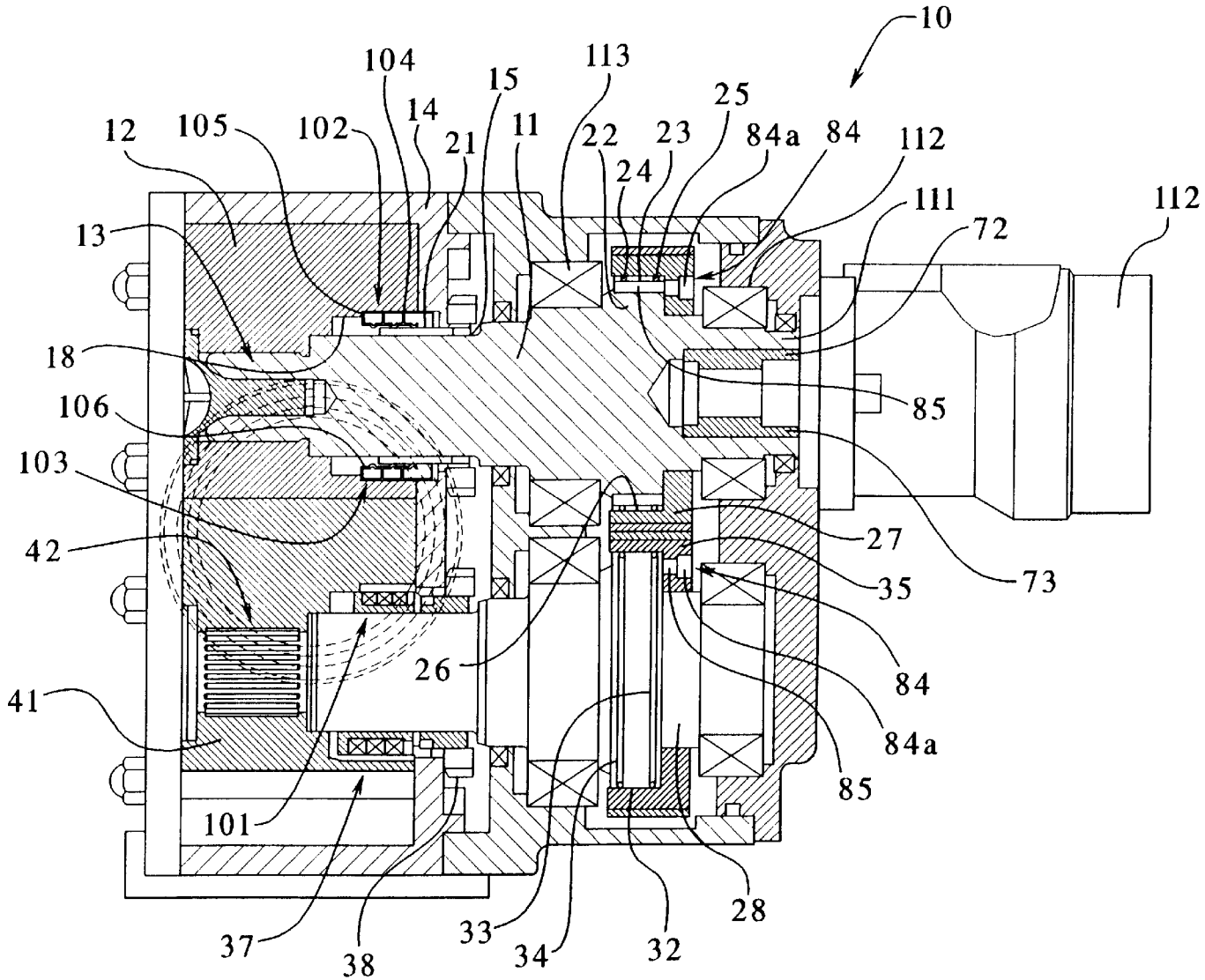
FIG. 9 is a sectional view illustrating four different seals for a rotary lobe pump made in accordance with the present invention.

FIG. 9 is a sectional view of the pump 10 illustrating the employment of three additional seal configurations. Specifically, the seal assembly 37 as shown in FIG. 1 is illustrated along with a smaller packing gland seal assembly 101 and two different lip seal assemblies 102 and 103. The packed gland seal assembly 101 is of a smaller size than the packed gland seal assembly 37. Specifically, the packed gland seal assembly 37 is an 8 mm sectioned packed gland arrangement while the seal assembly 101 is a 6 mm sectioned packed gland arrangement. The seal assembly 102 comprises an elastomeric radial lip seal arrangement whereby the outside surface 104 is accommodated in the slot 65 disposed in the rotor 12. The lips 105 extend radially inwardly and engage the outside surface 21 of the sleeve support 15. The seal assembly 103 is a stainless steel housed polytetrafluoroethylene lip seal with lips 106 that extend radially inwardly to engage the outside surface 21 of the sleeve support 15.

As shown in FIGS. 9 and 1, the inboard end 111 of the drive shaft 11 passes through a first support bearing 112 before it enlarges into the first boss 22. Thus, the inboard end 111 of the drive shaft 11 has a smaller diameter than the diameter of the boss 22. Then, the shaft 11 passes through a second support bearing 113 and the portion of the shaft 11 that passes through the support bearing 113 has a smaller diameter than the diameter of the first boss 22. Then, as the shaft 11 extends through the rotor case 14 and sleeve support 15, its diameter is reduced further. Finally, as the drive shaft 11 is connected to the first rotor 12 at the shaft/rotor connection 13, its diameter is even smaller. Thus, from the boss 22 to the shaft/rotor connection 13, the drive shaft 11 has a stepped-down configuration. An analogous configuration for the driven shaft 28 is also shown in FIGS. 1 and 9.

Figure 10:
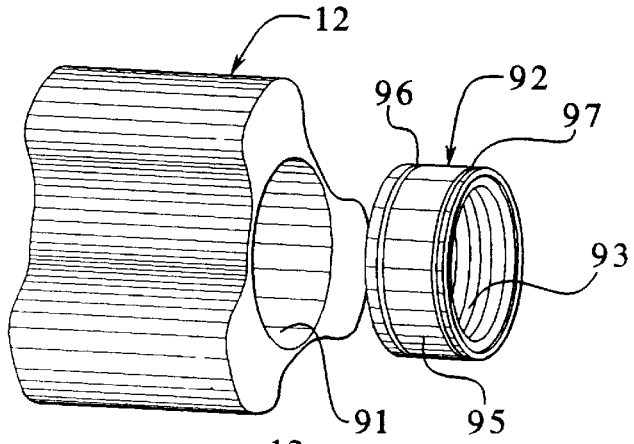
FIG. 10 is an exploded perspective view of a rotor, seal housing and seal of an additional embodiment of the present invention.
Figure 11:
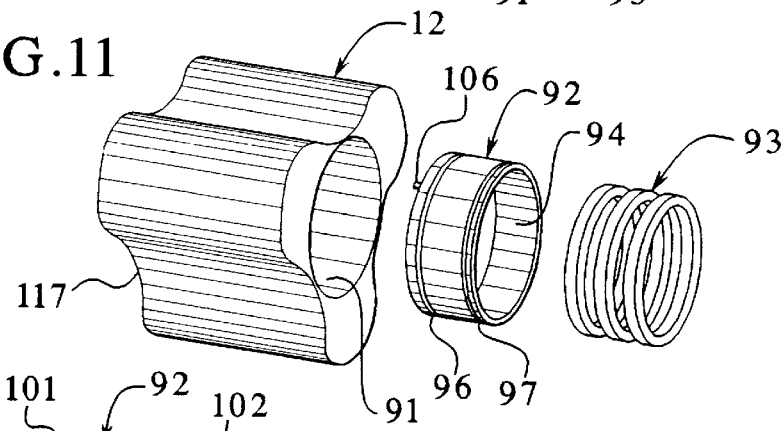
FIG. 11 is another exploded perspective view of the rotor, seal housing and seal shown in FIG. 10.
Figure 12:
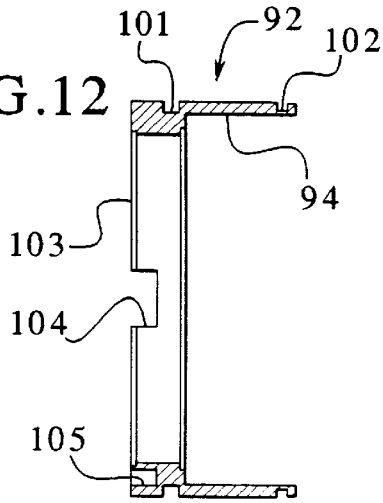
FIG. 12 is a side sectional view of a seal housing of the embodiment shown in FIG. 10.
Figure 13:
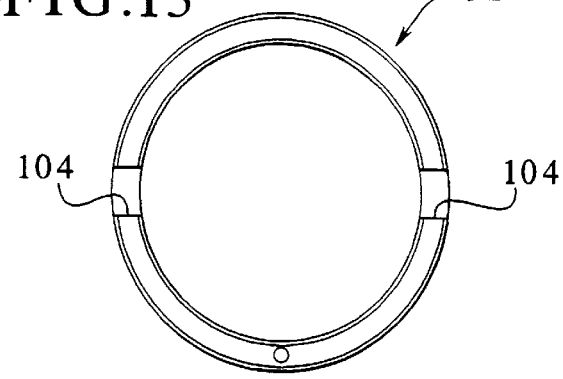
FIG. 13 is an end view of the seal housing shown in FIG. 12.

FIG. 10 illustrates a rotor 12 with an inside surface 91 that frictionally accommodates a seal housing 92. A seal 93 is press-fit into the seal housing 92 and is frictionally secured against the inside surface 94 of the seal housing 92. The outside surface 95 of the seal housing 92 is frictionally secured against the inside surface 91 of the rotor 12. The outside surface 95 of the seal housing 92 also includes at least two grooves for accommodating O-rings 96, 97 and for effectuating a seal between the outside surface 95 of the seal housing 92 and the inside surface 91 of the rotor 12. The seal housing 92 is further illustrated in FIGS. 12 and 13. Grooves 101, 102 accommodate the O-rings 96, 97. An inner end 103 of the housing 92 is directed toward the shafurotor connection 13 and may include slots 104 for accommodating a removal tool (not shown) to facilitate the removal of the seal assembly from the rotor 12. The housing 92 may also include a hole 105 for accommodating an anti-rotation pin shown at 106 in FIG. 11. The inside surface 94 of the seal housing 92 is intended to accommodate the wide variety of lip seals currently in use.

Figure 14:
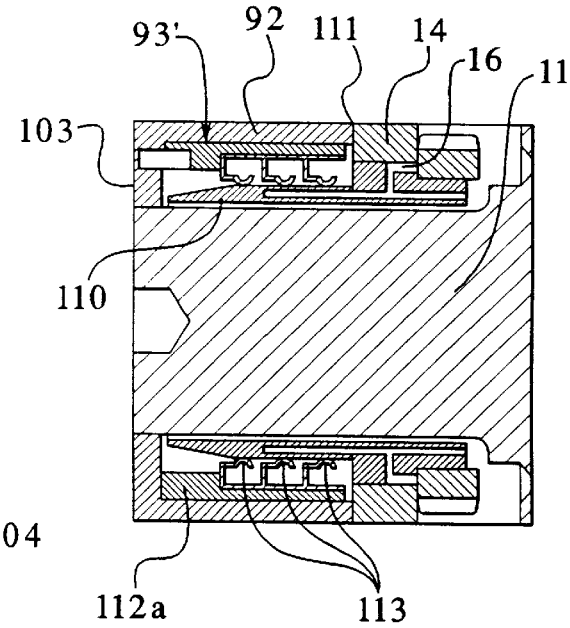
FIG. 14 is a partial sectional view of a pump equipped with the seal housing and seal shown in FIGS. 10 and 11.

As shown in FIG. 14, the housing 92 receives the shaft 11 which also passes through a sleeve support 110. The housing 92 is frictionally accommodated along the inside surface of the rotor 12 (not shown in FIG. 14; see FIGS. 10 and 11). The outer end 111 of the housing 92 engages the rotor case 14. Like the embodiments illustrated above, a lock nut 16 is used to secure the sleeve support 110 to the rotor housing 14. The seal 93' shown in FIG. 14 includes an outer sleeve 112*a* that is connected to a plurality of lips shown at 113 that extend radially inwardly to engage the sleeve support 110.

After the rotor 12 is disconnected from the shaft 11, the seal 93 (or 93') and the seal housing 92 may be quickly and easily removed from inside of the rotor 12 by inserting a removal tool through the end 117 of the rotor 12 (see FIG. 11) o engage the slots 104 of the seal housing 92 (see FIGS. 12 and 13) to force the seal housing 92 out of the rotor 12.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. A pump comprising:

a shaft extending through a rotor case before being connected to a rotor at a shaft/rotor connection, the rotor comprising an inside surface oppositely disposed to an outside surface of the shaft, the pump further comprising a seal assembly for providing a seal between the inside surface of the rotor and the outside surface of the shaft, the seal assembly comprising a sleeve support through which the shaft passes before the shaft is connected to the rotor, the sleeve support being connected to the rotor case, the sleeve support extending from the rotor case along the shaft towards the shaft/rotor connection, the sleeve support passing through an elongated seal, the elongated seal being accommodated in a seal housing and between the sleeve support and the seal housing, the seal housing being frictionally accommodated in the inside surface of the rotor and between the elongated seal and the inside surface of the rotor.

2. The pump of claim 1 wherein the elongated seal being disposed between the shaft/rotor connection and the rotor case, the elongated seal being frictionally secured to an inner surface of the seal housing and extending radially inwardly to engage an outside surface of the sleeve support.

3. The pump of claim 1 wherein the elongated seal comprises a multiple lip seal.

4. The pump of claim 3 wherein the lip seal comprises an inner side comprising a plurality of lips that extend axially inwardly towards the rotor case, the lips each comprising an inner surface that engages the outside surface of the sleeve support.

5. The pump of claim 1 wherein the elongated seal comprises an external packed gland seal.

6. The pump of claim 5 wherein the packed gland seal comprises a plurality of packed glands each having an inside surface that engages the outside surface of the sleeve support.

7. The pump of claim 1 wherein the seal housing comprising an outer surface with at least one circumferential groove disposed therein for accommodating an O-ring, the O-ring being trapped between the seal housing and the inside surface of the rotor.

8. The pump of claim 1 wherein the seal housing comprises an outer surface that comprises two circumferential grooves disposed therein, each groove accommodating an O-ring for providing a seal between the outer surface of the seal housing and the inside surface of the rotor.

9. The pump of claim 1 wherein the sleeve support comprises a threaded section disposed opposite the rotor case from the rotor, the threaded section for threadably receiving a threaded lock ring, the threaded lock ring engaging the rotor case and securing the sleeve support against the rotor case.

10. The pump of claim 1 further comprising at least one seal trapped between the rotor case and the sleeve support.

11. A pump comprising:

a shaft extending through a rotor case before being connected to a rotor at a shaft/rotor connection, the rotor comprising an inside surface oppositely disposed to an outside surface of the shaft, the pump further comprising a seal assembly for providing a seal between the inside surface of the rotor and the outside surface of the shaft, the seal assembly comprising a sleeve support through which the shaft passes before the shaft is connected to the rotor, the sleeve support being connected to the rotor case, the sleeve support extending from the rotor case along the shaft towards the shaft/rotor connection, the sleeve support passing through an elongated seal, the elongated seal being accommodated in a seal housing and between the sleeve support and the seal housing, the seal housing being frictionally accommodated in the inside surface of the rotor and between the elongated seal and the inside surface of the rotor, the seal housing comprising an outer surface with at least one circumferential groove disposed therein for accommodating an O-ring, the O-ring being trapped between the seal housing and the inside surface of the rotor, the elongated seal being disposed between the shaft/rotor connection and the rotor case, the elongated seal being frictionally secured to an inner surface of the seal housing and extending radially inwardly to engage an outside surface of the sleeve support.

12. The pump of claim 11 wherein the elongated seal comprises a multiple lip seal comprising an inner side comprising a plurality of lips that extend axially inwardly towards the rotor case, the lips each comprising an inner surface that engages the outside surface of the sleeve support.

13. The pump of claim 11 wherein the elongated seal comprises an external packed gland seal comprising a plurality of packed glands each having an inside surface that engages the outside surface of the sleeve support.

14. The pump of claim 11 wherein the sleeve support comprises a threaded section disposed opposite the rotor case from the rotor, the threaded section for threadably receiving a threaded lock ring, the threaded lock ring engaging the rotor case and securing the sleeve support against the rotor case.

* * * * *